US006170740B1

(12) United States Patent
Clark

(10) Patent No.: US 6,170,740 B1
(45) Date of Patent: Jan. 9, 2001

(54) OVAL FOLDING CARTON WITH AUTOMATIC CLOSING BOTTOM

(75) Inventor: Mitchell Clark, Great Neck Long Island, NY (US)

(73) Assignee: International Paper, Tuxedo, NY (US)

( * ) Notice: Under 35 U.S.C. 154(b), the term of this patent shall be extended for 0 days.

(21) Appl. No.: 09/476,510

(22) Filed: Jan. 3, 2000

Related U.S. Application Data

(63) Continuation-in-part of application No. 09/334,002, filed on Jun. 15, 1999.

(51) Int. Cl.[7] ..... B65D 5/00

(52) U.S. Cl. ..... 229/117.04; 229/4.5; 229/104; 229/117.06; 229/128

(58) Field of Search ..... 229/4.5, 5.5, 104, 229/128, 116.1, 117.03, 117.04, 117.05, 117.06

(56) References Cited

U.S. PATENT DOCUMENTS 1,184,956 * 5/1916 Hoppke ..... 229/4.5
1,733,674 * 10/1929 Scheicher ..... 229/4.5
1,803,239 * 4/1931 Deane ..... 229/4.5
3,637,130 * 1/1972 Farquhar ..... 229/128
3,790,064 * 2/1974 Kramer ..... 229/117
3,899,124 * 8/1975 Desmond et al. ..... 229/117
3,912,331 * 10/1975 Turner et al. ..... 229/104
3,929,222 * 12/1975 Smith et al. ..... 229/128
4,109,848 * 8/1978 Kipp et al. ..... 229/104
4,428,500 * 1/1984 Kohler ..... 229/117.05
4,856,705 * 8/1989 Carr et al. ..... 229/117
5,061,501 * 10/1991 Lowe ..... 229/128
5,484,100 * 1/1996 Rigby ..... 229/117
5,630,543 * 5/1997 Dugan ..... 229/117
5,669,549 * 9/1997 Robertson ..... 229/4.5
5,669,550 * 9/1997 Klemme et al. ..... 229/4.5
5,816,483 * 10/1998 Gasper ..... 229/117
5,893,458 * 4/1999 Sisk ..... 229/117
5,911,358 * 6/1999 Kenner et al. ..... 229/116.1

* cited by examiner

*Primary Examiner*—Gary E. Elkins
(74) *Attorney, Agent, or Firm*—Richard R. Muccino

(57) ABSTRACT

The present invention is directed to a one piece blank of foldable sheet material cut and scored so that it is divided into a series of connected wall forming panels which when assembled provides an oval folding carton with an automatic closing bottom for packaging an article. The present invention is also directed to a one piece oval shaped carton with an automatic closing bottom for packaging an article.

7 Claims, 6 Drawing Sheets

OVAL FOLDING CARTON WITH AUTOMATIC CLOSING BOTTOM

This application is a C-I-P of Ser. No. 09/334,002 filed Jun. 15, 1999.

FIELD OF THE INVENTION

The present invention is directed to a one piece blank of foldable sheet material cut and scored so that it is divided into a series of connected wall forming panels which when assembled provides an oval folding carton with an automatic closing bottom for packaging an article. The present invention is also directed to a one piece oval shaped carton with an automatic closing bottom for packaging an article.

DESCRIPTION OF THE BACKGROUND

Many types of cartons for packaging articles are known. However, these cartons have not been suitable for use when an automatic closing bottom carton is desired, such as a carton which can be folded flat and then loaded onto normal filling equipment. The preparation of such a carton, particularly an oval shaped carton, where the bottom of the flat folded carton automatically erects during filling, generally requires several steps.

U.S. Pat. No. 1,184,956 (Hoppke) discloses a pastry cup having a segmental member with its opposite ends secured together to form a shell. Two bottom members are arranged to fit within the shell at the lower end and are secured together and two necks integrally connect the bottom members within the shell and are located within the shell opposite each other. U.S. Pat. No. 1,733,674 (Schleicher) discloses a box having an inside bottom-forming sheet with a continuously curved edge. A side wall is provided for the box having an elongated strip with V-shaped tongues extending from one edge and bent inwardly and glued against the under side of the bottom sheet. U.S. Pat. No. 1,803,239 (Deane) discloses a carton constructed of a blank having a main portion shaped to form a cylindrical hollow body. A pair of circular portions are provided with one edge of the main portion forming end closure members consisting of an inner closure member and an outer flanged closure member for one end of the hollow body. U.S. Pat. No. 3,101,167 (Styler) discloses an automatic bottom hexagonal carton erectable by a single application of compressive forces on the edges of the carton when in a collapsed condition. A bottom flap is secured to the bottom edge of a first side panel and is creased at its mid-portion so that it may be folded back upon itself. When the bottom flap unfolds during the application of opening forces to the collapsed container, the flap pulls the bottom dust flap into position. U.S. Pat. No. 3,790,064 (Kramer) discloses a carton with an automatic lock bottom construction. The carton has four main panels hinged together and is erectable from a collapsed condition into a locked erected condition. The lock means is a bottom lock flap with a projecting finer-like tab. During the erection of the carton, secured hook tabs and adjacent rectangular projections lift each other and unfold from against the main panels. U.S. Pat. No. 3,899,124 (Desmond et al.) discloses a collapsible carrying carton adapted to be brought from a collapsed condition to an erected condition by the application of pressure against two opposed corners. The bottom closure includes include a flat, unscored, bottom panel attached at one edge to a lower edge of a related major side wall and having a recess for interlocking with a corresponding recess in the bottom panel of the other closure flap of the first pair when the carton is in erected condition. U.S. Pat. No. 4,109,848 (Kipp et al.) discloses a tubular carton formed from a cut and scored blank of paperboard. A recessed, concavely depressed bottom wall is formed from two overlapping bottom panel portions secured to each other. The side wall has remote side edges secured to each other in an overlapped relation to form a tubular structure collapsible into a substantially flat configuration. U.S. Pat. No. 4,428,500 (Kohler) discloses a collapsible, automatically erectable, liquid-tight tray. The tray has an outer shell formed from a unitary blank of foldable paperboard and a pair of opposed side wall panels joined to each other at corresponding side edges to form, when in the erected position, a tubular structure open at the top. U.S. Pat. No. 4,856,705 (Carr et al.) discloses an automatically-operating bottom structure for a collapsible container to be selectively moved between a folded-flat condition and a fully-expanded condition. Interlock means are provided for interlocking the bottom flaps when the container is in the fully-expanded condition. When the container is moved from the folded-flat condition to the fully expanded condition, a band will prevent the flaps from moving relative to their associated first panels. U.S. Pat. No. 5,484,100 (Rigby) discloses a tapered, hexagonal paperboard container having two paperboard bottom panels and six paperboard side panels connected to each other to form a tapered, hexagonal container. U.S. Pat. No. 5,630,543 (Dugan) discloses a bulk bin box having a unitary piece of cardboard folded into an octagonal box having a top portion and a bottom portion and two tabs on opposite sides of the box with each tab having a slot. Each tab slot simultaneously and continuously intermeshes with the other tab whereby no action other than opening the box is necessary to erect the box. U.S. Pat. No. 5,669,549 (Robertson) discloses a container having a longitudinal axis for storing and packaging dry, semi-dry or liquid goods. The container has a closed bottom and an upstanding sidewall wrapped about the longitudinal axis of the container and extending from the closed bottom to form a storage cavity. U.S. Pat. No. 5,669,550 (Klemme et al.) discloses a container having a longitudinal axis for storing and packaging one or more dry, semi-dry and/or liquid goods. The container has a closed bottom and a continuous sidewall wrapped about the longitudinal axis and extending upwardly from the closed bottom to an upper rim. U.S. Pat. No. 5,816,483 (Gasper) discloses a container to be selectively moved between a folded condition and an expanded condition. Panels are arranged in opposing pairs when the container is in an expanded condition and first and second sections are disposed with one another and with their respective panels so as to be parallel to one another when the container is in a folded condition and co-planar to one another when the container is in the expanded condition. U.S. Pat. No. 5,893,458 (Sisk) discloses a carton having a top closure, several side panels, several auto-bottom panels each connected to a bottom edge of one of the side panels, and several spaced panels connected to some of the auto-bottom panels. When the carton is erected, the auto-bottom panels form a generally planar bottom of the carton, and the spacer panels extend generally axially into the carton from the bottom to form a two-dimensional support base for holding an object at a location spaced above the bottom of the carton.

IN THE FIGURES

SUMMARY OF THE INVENTION

The present invention is directed to a one piece blank of foldable sheet material cut and scored so that it is divided into a series of connected wall forming panels which when assembled provides an oval folding carton with an automatic closing bottom for packaging an article, wherein the blank comprises:

(a) first, second, and third rectangular wall panels positioned in lateral alignment and connected by vertical fold lines, each wall panel having a top, a bottom, and two sides;

(b) first and second rectangular supporting shoulders foldably connected to the first and second rectangular wall panels, respectively; wherein the first and second rectangular supporting shoulders have a top, a bottom, and two sides, and the tops of the first and second supporting shoulders are connected to the bottoms of the first and second rectangular wall panels, respectively; and (c) first and second oval bottom closing flaps foldably connected to the first and second supporting shoulders, respectively, for automatically closing the carton; wherein the first and second oval bottom closing flaps have a top, a bottom, and two sides, and the second oval bottom closing flap contains a reverse fold, the top of the first and second oval bottom closing flaps being connected to the bottom of the first and second rectangular supporting shoulders, respectively.

In another embodiment, the invention is directed to a one piece oval shaped carton with an automatic closing bottom for packaging an article comprising:

(a) first, second, and third rectangular wall panels, each rectangular wall panel having a top, a bottom, and two sides;

(b) first and second rectangular supporting shoulders, each rectangular supporting shoulder having a top, a bottom, and two sides; and (c) first and second oval bottom closing flaps, each oval bottom closing flap having a top, a bottom, and two sides, and the second bottom closing flap having a reverse fold;

wherein the first and second rectangular wall panels are connected to each other along a common side, the second and third rectangular wall panels are connected to each other along a common side, the third rectangular wall panel is folded over the first rectangular wall panel and attached to the panel via a glue panel; the tops of the first and second supporting shoulders are connected via glue panels to the bottoms of the first and second rectangular wall panels, respectively, and are folded inside the carton; the tops of the first and second bottom closing flaps are connected to the bottoms of the first and second supporting shoulders, respectively, and are folded inside the carton; and the second bottom closing flap is connected via a glue panel to the reverse of the first bottom closing flap to form the one piece oval shaped carton with an automatic closing bottom for packaging an article.

DETAILED DESCRIPTION OF THE INVENTION

Figure 1:
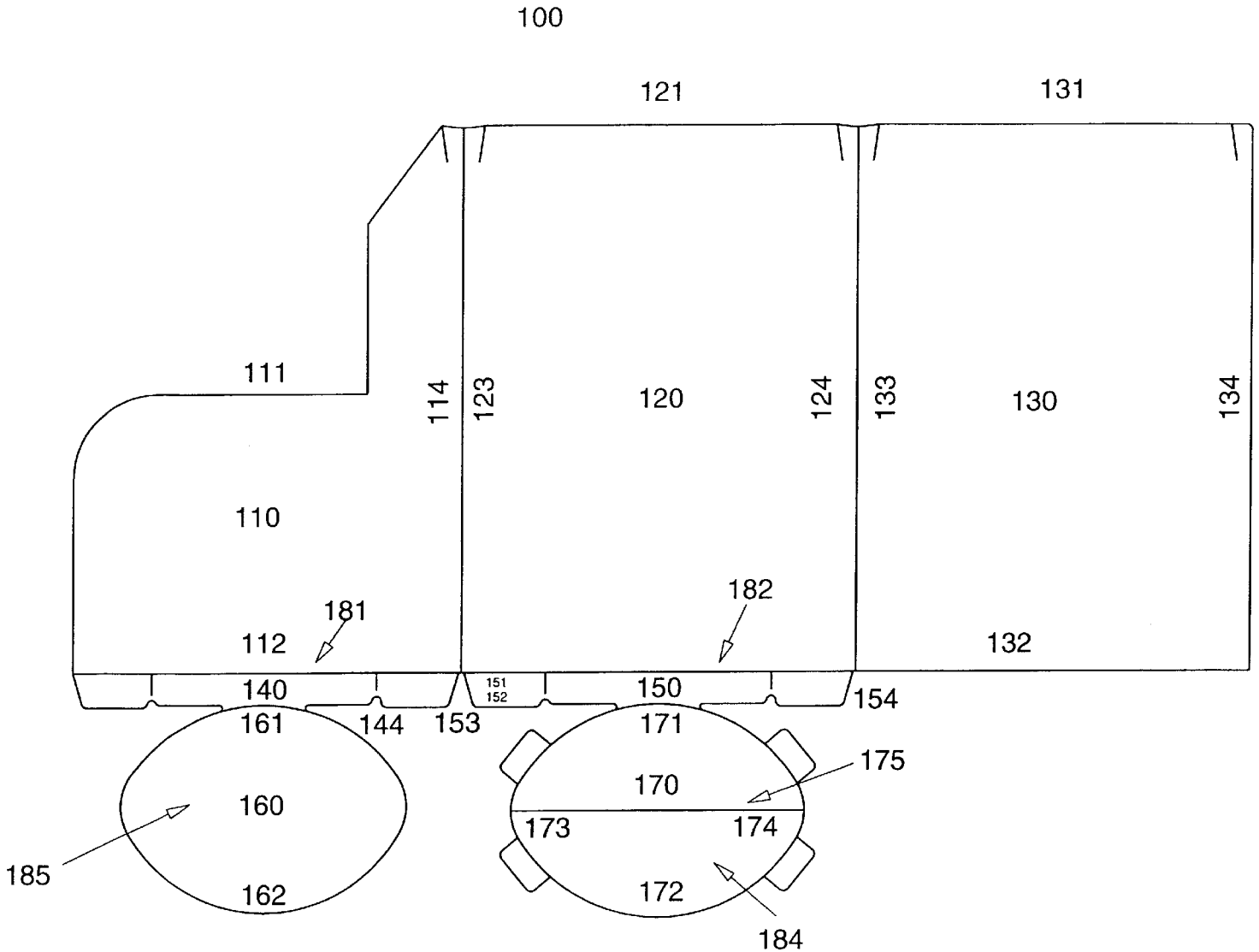
FIG. 1 shows a flat view of one piece stock, unassembled, from which the oval folding carton with an automatic closing bottom may be made constructed in accordance with a preferred embodiment of the present invention.
Figure 2:
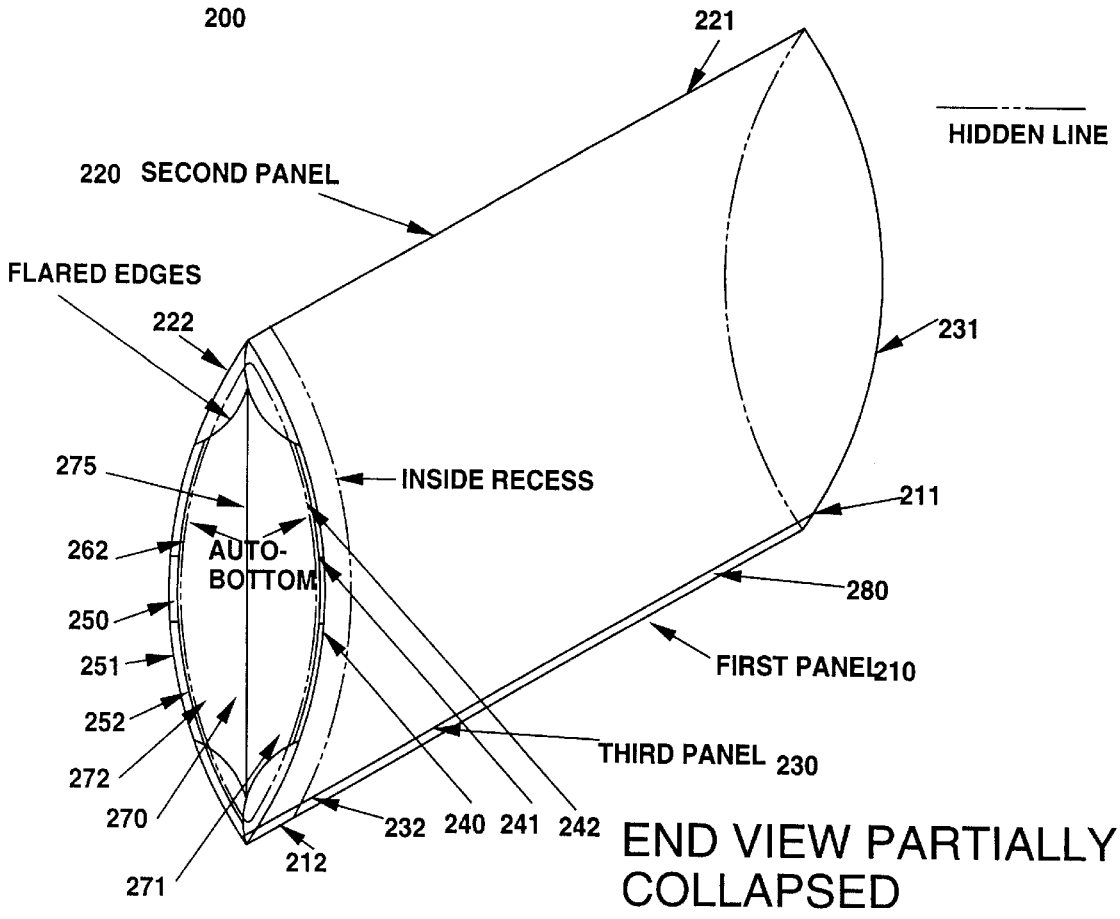
FIG. 2 shows an end view of the oval shaped carton with an automatic closing bottom in assembled and flat or collapsed form constructed in accordance with a preferred embodiment of the present invention.
Figure 4:
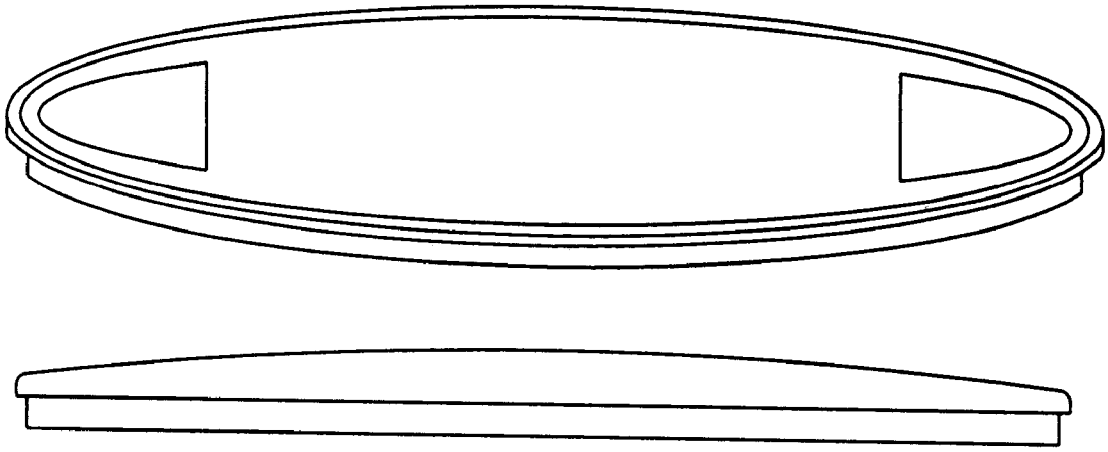
FIG. 4 shows three different views of a plastic or paperboard plug or top which may be used to close the top of the oval shaped carton with an automatic closing bottom and maintain its structure in accordance with a preferred embodiment of the present invention.
Figure 5:
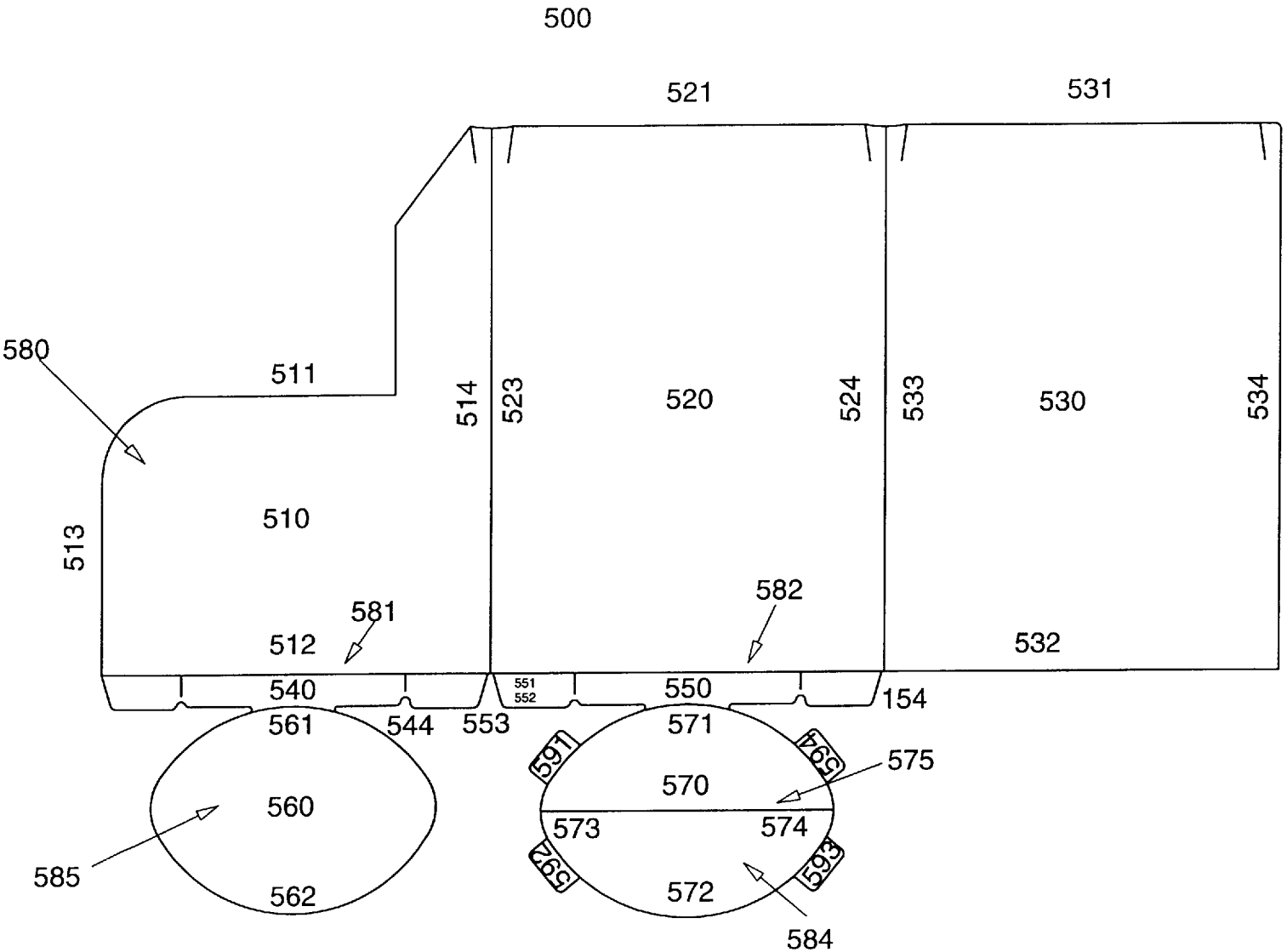
FIG. 5 shows a flat view of one piece stock, unassembled, from which the oval folding carton with an automatic closing bottom may be made including supporting flaps constructed in accordance with a preferred embodiment of the present invention.
Figure 6:
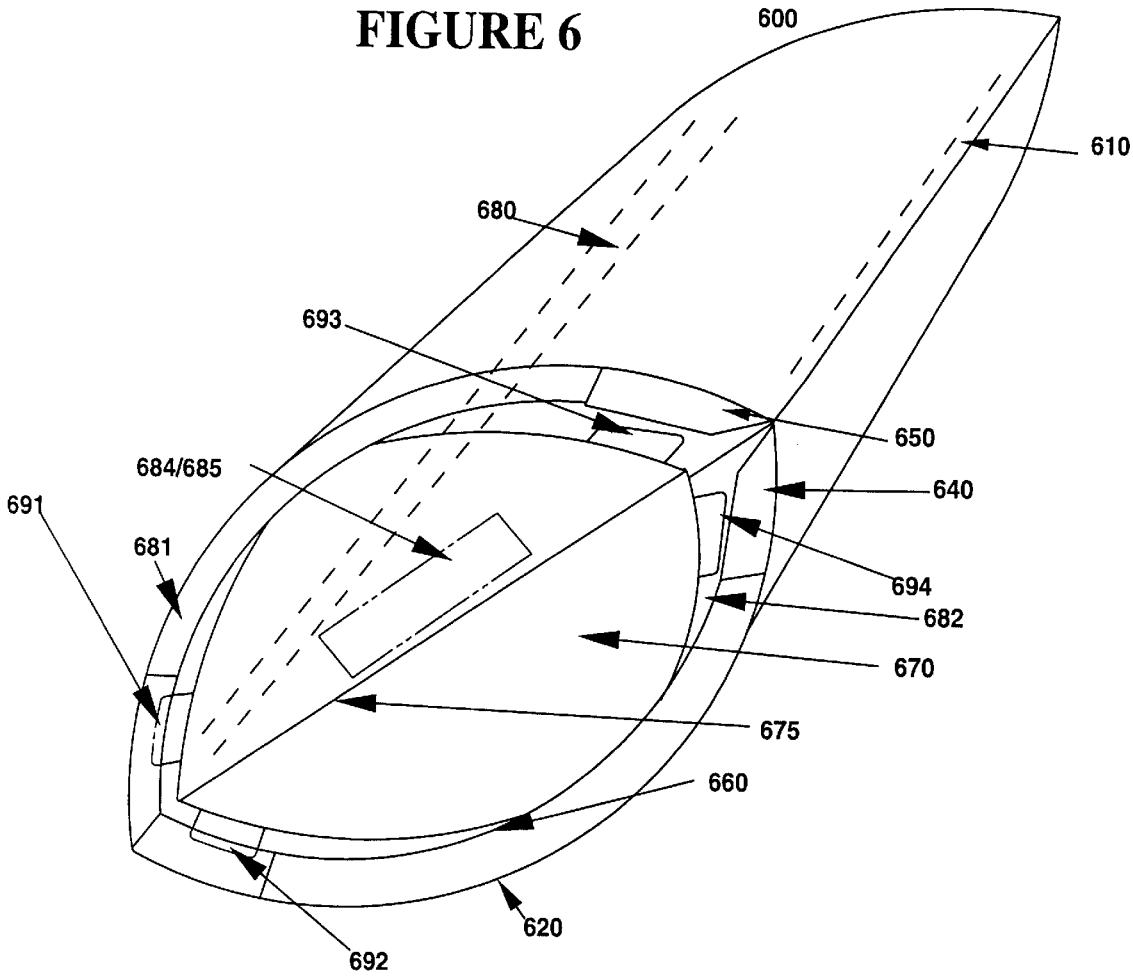
FIG. 6 shows an end view of the oval shaped carton with an automatic closing bottom in assembled and open or erected form including supporting flaps constructed in accordance with a preferred embodiment of the present invention.

The present invention pertains to a blank for an oval folding carton with an automatic bottom. FIG. 1 shows a flat view of a one piece stock, unassembled, from which the oval folding carton may be made. The blank contains three rectangular wall panels and two oval bottom closing flaps. The oval bottom closing flaps are connected to the rectangular wall panels through rectangular supporting shoulders. One of the oval bottom closing flaps contains a reverse fold. FIG. 2 shows the blank formed into a flat folding oval carton by folding over the rectangular wall panels. The oval bottom closing flaps are folded inside the carton and one of the oval bottom closing flaps is reverse folded inside the carton. When the flat folded oval carton is loaded onto normal filling equipment, the reverse fold of the oval bottom closing flap causes the bottom of the flat folded oval carton to automatically erect and be supported on the rectangular supporting shoulders (see FIG. 3). FIG. 4 shows different views of a plastic or paperboard plug which may be used to close the top of the oval shaped carton and maintain its structure. FIG. 5 shows a flat view of one piece stock, unassembled, from which the oval folding carton with an automatic closing bottom may be made including supporting flaps. FIG. 6 shows an end view of the oval shaped carton with an automatic closing bottom including supporting flaps in assembled and open or erected form. The advantage of the novel oval folding carton is that it can be made from one piece of stock, can be assembled into a flat folded carton for shipping, and automatically erects when loaded onto filling equipment. The oval folding carton is also useful as a novelty package for various consumer products.

The invention will be better understood from the following detailed description of the preferred embodiments taken in conjunction with the Figures, in which like elements are represented by like referenced numerals.

In FIG. 1, a one piece blank of foldable sheet material is depicted generally as 100 and constructed in accordance with a preferred embodiment of the present invention. Blank 100 is cut and scored so that it is divided into a series of connected wall forming panels which when assembled provides a one piece oval shaped carton with an automatic closing bottom for packaging an article.

Blank 100 comprises first (110), second (120), and third (130) rectangular wall panels of substantially equal size positioned in lateral alignment and connected by vertical fold lines (114/123, 124/133). Each wall panel has a top (111, 121, 131), a bottom (112, 122, 132), and two sides, a left side (113, 123, 133), and a right side (114, 124, 134).

First (140) and second (150) rectangular supporting shoulders are of substantially equal size and are foldably connected to the first (110) and second (120) rectangular wall panels, respectively. The first (140) and second (150) rectangular supporting shoulders have a top (141, 151), a bottom (142, 152), and two sides, a left side (143, 153), and a right side (144, 154), respectively. The tops of the first and second supporting shoulders (141, 151) are connected to the bottoms of the first and second rectangular wall panels (112, 122), respectively.

First (160) and second (170) oval bottom closing flaps are of substantially equal size and are foldably connected to the first (140) and second (150) supporting shoulders, respectively, for automatically closing the carton. The first (160) and second (170) oval bottom closing flaps have a top (161, 171), a bottom (162, 172), and two sides, a left side (163, 173), and a right side (164, 174), respectively. The second bottom closing flap (170) contains a reverse fold (175). The tops of the first (161) and second (171) oval bottom closing flaps are connected to the bottoms of the first (142) and second (152) rectangular supporting shoulders, respectively.

For subsequent folding of blank 100 into a one piece oval shaped carton with an automatic closing bottom, blank 100 will also contain glueable panel 180. The third (130) rectangular wall panel may then be folded over the first (110) rectangular wall panel and attached to the panel via glue panel (180). Blank 100 will also contain glue panels (181 and 182). The first (140) and second (150) supporting shoulders may then be connected via glue panels (181 and 182), respectively, to the first (110) and second (120) rectangular wall panels, respectively, and folded inside the carton. Blank 100 will also contain glue panels (184 and 185). Glue panel 184 on the second bottom closing flap (170) may then be connected to glue panel 185 on the reverse of the first (160) bottom closing flap to form the one piece oval shaped carton with an automatic closing bottom for packaging an article.

Optionally, at least one rectangular wall panel in the one piece blank of foldable sheet material may contain a cut out for a window (not shown).

FIG. 2 shows an end view of the oval shaped carton with an automatic closing bottom in assembled and flat or collapsed form, depicted generally as 200, constructed in accordance with a preferred embodiment of the present invention.

The one piece oval shaped carton with an automatic closing bottom 200 comprises first (210), second (220), and third (230) rectangular wall panels of substantially equal size. Each rectangular wall panel has a top (211, 221, 231), a bottom (212, 222, 232), and two sides (not numbered).

First (240) and second (250) rectangular supporting shoulders are of substantially equal size, and preferably have flared edges. Each rectangular supporting shoulder has a top (241, 251), a bottom (242, 252), and two sides (not numbered).

First (260) and second (270) oval bottom closing flaps of substantially equal size. Each oval bottom closing flap has a top (261, 271), a bottom (262, 272), and two sides (not numbered). The second bottom closing flap (270) has a reverse fold (275).

The first (210) and second (220) rectangular wall panels are connected to each other along a common side. The second (220) and third (230) rectangular wall panels are connected to each other along a common side. The third (230) rectangular wall panel is folded over the first (210) rectangular wall panel and attached to the panel via a glue panel (280). The tops of the first (241) and second (251) supporting shoulders are connected to the bottoms of the first (212) and second (222) rectangular wall panels, respectively, and are folded inside the carton. The tops of the first (261) and second (271) bottom closing flaps are connected to the bottoms of the first (242) and second (252) supporting shoulders, respectively, and are folded inside the carton. The second bottom closing flap is reverse folded (275) to form the one piece oval shaped carton with an automatic closing bottom for packaging an article.

Optionally, at least one rectangular wall panel in the one piece oval shaped carton with an automatic closing bottom may contain a cut out for a window (not shown).

Figure 3:
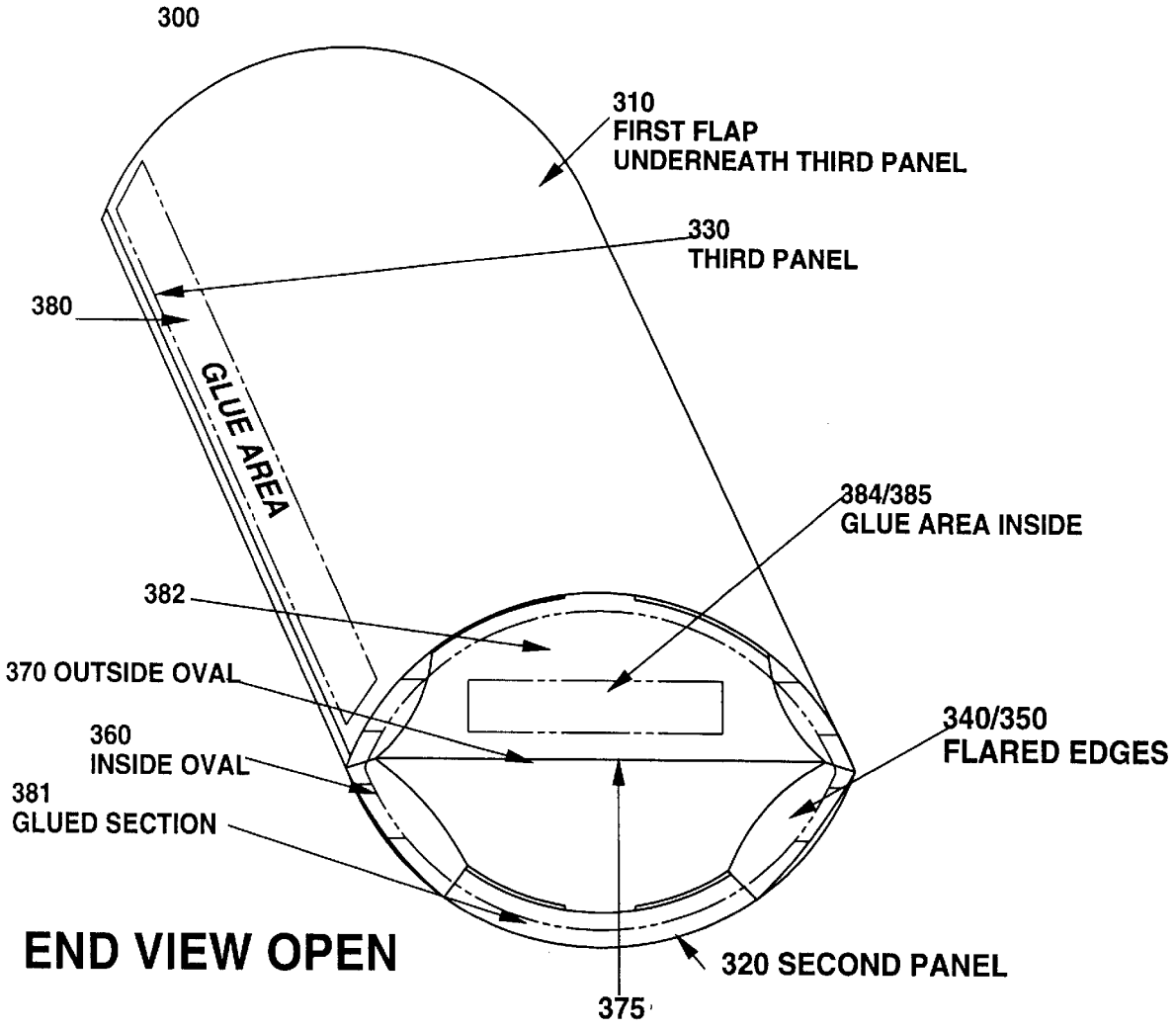
FIG. 3 shows an end view of the oval shaped carton with an automatic closing bottom in assembled and open or erected form constructed in accordance with a preferred embodiment of the present invention.

FIG. 3 shows an end view of the oval shaped carton with an automatic closing bottom in assembled and open or erected form, generally depicted as 300, constructed in accordance with a preferred embodiment of the present invention.

The one piece oval shaped carton with an automatic closing bottom 300 comprises first (310), second (320), and third (330) rectangular wall panels of substantially equal size. Each rectangular wall panel has a top, a bottom, and two sides (not numbered).

First (340) and second (350) rectangular supporting shoulders are of substantially equal size, and preferably have flared edges. Each rectangular supporting shoulder has a top, a bottom, and two sides (not numbered).

First (360) and second (370) oval bottom closing flaps are of substantially equal size. Each oval bottom closing flap has a top, a bottom, and two sides (not numbered). The second bottom closing flap (370) has a reverse fold (375).

The first (310) and second (320) rectangular wall panels are connected to each other along a common side. The second (320) and third (330) rectangular wall panels are connected to each other along a common side. The third (330) rectangular wall panel is folded over the first (310) rectangular wall panel and attached to the panel via glue panel (380). The first (340) and second (350) supporting shoulders are connected via glue panels (381 and 382), respectively, to the first (310) and second (320) rectangular wall panels, respectively, and are folded inside the carton. The first (360) and second (370) bottom closing flaps are connected to the first (340) and second (350) supporting shoulders, respectively, and are folded inside the carton. Glue panel 384 on the second bottom closing flap (370) is connected to glue panel 385 on the reverse of the first (360) bottom closing flap to form the one piece oval shaped carton with an automatic closing bottom for packaging an article.

FIG. 4 shows three different views of a plastic or paperboard plug may be used to close the top of the oval shaped carton with an automatic closing bottom and maintain its structure in accordance with a preferred embodiment of the present invention.

In FIG. 5, a one piece blank of foldable sheet material is depicted generally as 500 and constructed with four support flaps in accordance with a preferred embodiment of the present invention. Blank 500 is cut and scored so that it is divided into a series of connected wall forming panels which when assembled provides a one piece oval shaped carton with an automatic closing bottom for packaging an article.

Blank 500 comprises first (510), second (520), and third (530) rectangular wall panels positioned in lateral alignment and connected by vertical fold lines (514/523, 524/533). Each wall panel has a top (511, 521, 531), a bottom (512, 522, 532), and two sides, a left side (513, 523, 533), and a right side (514, 524, 534).

First (540) and second (550) rectangular supporting shoulders are foldably connected to the first (510) and second (520) rectangular wall panels, respectively. The first (540) and second (550) rectangular supporting shoulders have a top (541, 551), a bottom (542, 552), and two sides, a left side (543, 553), and a right side (544, 554), respectively. The tops of the first and second supporting shoulders (541, 551) are connected to the bottoms of the first and second rectangular wall panels (512, 522), respectively.

First (560) and second (570) oval bottom closing flaps are of substantially equal size and are foldably connected to the first (540) and second (550) supporting shoulders, respectively, for automatically closing the carton. The first (560) and second (570) oval bottom closing flaps have a top (561, 571), a bottom (562, 572), and two sides, a left side (563, 573), and a right side (564, 574), respectively. The second bottom closing flap (570) contains a reverse fold (575). The tops of the first (561) and second (571) oval bottom closing flaps are connected to the bottoms of the first (542) and second (552) rectangular supporting shoulders, respectively. The second bottom closing flap (570) also contains four support flaps (591, 592, 593, and 594) behind the flared edges providing a positive support to prevent the bottom from pushing beyond the designated recessed edge.

For subsequent folding of blank 500 into a one piece oval shaped carton with an automatic closing bottom, blank 500 will also contain glueable panel 580. The third (530) rectangular wall panel may then be folded over the first (510) rectangular wall panel and attached to the panel via glue panel (580). Blank 500 will also contain glue panels (581 and 582). The first (540) and second (550) supporting shoulders may then be connected via glue panels (581 and 582), respectively, to the first (510) and second (520) rectangular wall panels, respectively, and folded inside the carton. Blank 500 will also contain glue panels (584 and 585). Glue panel 584 on the second bottom closing flap (570) may then be connected to glue panel 585 on the reverse of the first (560) bottom closing flap to form the one piece oval shaped carton with an automatic closing bottom for packaging an article.

Optionally, at least one rectangular wall panel in the one piece blank of foldable sheet material may contain a cut out for a window (not shown).

FIG. 6 shows an end view of the oval shaped carton with an automatic closing bottom in assembled and open or erected form, generally depicted as 600, constructed with four support flaps in accordance with a preferred embodiment of the present invention.

The one piece oval shaped carton with an automatic closing bottom 600 comprises first (610), second (620), and third (630) rectangular wall panels. Each rectangular wall panel has a top, a bottom, and two sides (not numbered).

First (640) and second (650) rectangular supporting shoulders preferably have flared edges. Each rectangular supporting shoulder has a top, a bottom, and two sides (not numbered).

First (660) and second (670) oval bottom closing flaps are of substantially equal size. Each oval bottom closing flap has a top, a bottom, and two sides (not numbered). The second bottom closing flap (670) has a reverse fold (675). The second bottom closing flap (670) also contains four support flaps (691, 692, 693, and 694) behind the flared edges providing a positive support to prevent the bottom from pushing beyond the designated recessed edge.

The first (610) and second (620) rectangular wall panels are connected to each other along a common side. The second (620) and third (630) rectangular wall panels are connected to each other along a common side. The third (630) rectangular wall panel is folded over the first (610) rectangular wall panel and attached to the panel via glue panel (680). The first (640) and second (650) supporting shoulders are connected via glue panels (681 and 682), respectively, to the first (610) and second (620) rectangular wall panels, respectively, and are folded inside the carton. The first (660) and second (670) bottom closing flaps are connected to the first (640) and second (650) supporting shoulders, respectively, and are folded inside the carton. Glue panel 684 on the second bottom closing flap (670) is connected to glue panel 685 on the reverse of the first (660) bottom closing flap to form the one piece oval shaped carton with an automatic closing bottom for packaging an article.

The one piece oval shaped carton for packaging an article of the present invention provides cartons having an automatic closing bottom. The cartons can be used with automatic machinery equipment which will erect the carton in the machine and will automatically fill the carton with the article or articles to be packaged. The face of the one piece oval shaped carton with an automatic closing bottom for packaging an article of the present invention are clean in their original, glued, sealed position.

The one piece oval shaped carton with an automatic closing bottom can be used to accommodate a wide variety of articles or products in different container sizes. While the one piece oval shaped carton with an automatic closing bottom for packaging an article has been shown in connection with certain preferred embodiments as shown, other embodiments of different shapes or locations can be utilized with varying container shapes. In addition, more or less score lines can be added as appropriate to make the one piece oval shaped carton with an automatic closing bottom for packaging an article more flexible for machine insertion of the object to be packaged. In addition, multiple cutouts can be utilized where appropriate for either multiple objects to be held or due to the shape of the object to be held.

The invention being thus described, it will be obvious that the same may be varied in many ways. Such variations are not to be regarded as a departure from the spirit and scope of the invention and all such modifications are intended to be included within the scope of the following claims.

I claim:

1. A one piece blank of foldable sheet material cut and scored so that it is divided into a series of connected wall forming panels which when assembled provides an oval folding carton with an automatic closing bottom for packaging an article, wherein the blank comprises:

(a) first, second, and third rectangular wall panels positioned in lateral alignment and connected by vertical fold lines, each wall panel having a top, a bottom, and two sides;

(b) first and second rectangular supporting shoulders foldably connected to the first and second rectangular wall panels, respectively; wherein the first and second rectangular supporting shoulders have a top, a bottom, and two sides, and the tops of the first and second supporting shoulders are connected to the bottoms of the first and second rectangular wall panels, respectively; and (c) first and second oval bottom closing flaps foldably connected to the first and second supporting shoulders, respectively, for automatically closing the carton; wherein the first and second oval bottom closing flaps have a top, a bottom, and two sides, and the second oval bottom closing flap contains a reverse fold, the top of the first and second oval bottom closing flaps being connected to the bottom of the first and second rectangular supporting shoulders, respectively.

2. The one piece blank of foldable sheet material according to claim 1, wherein the first, second, and third rectangular wall panels are of substantially equal size.

3. The one piece blank of foldable sheet material according to claim 1, wherein the second oval bottom closing flap further comprises four support flaps.

4. A one piece oval shaped carton with an automatic closing bottom for packaging an article comprising:

(a) first, second, and third rectangular wall panels, each rectangular wall panel having a top, a bottom, and two sides;

(b) first and second rectangular supporting shoulders, each rectangular supporting shoulder having a top, a bottom, and two sides; and (c) first and second oval bottom closing flaps, each oval bottom closing flap having a top, a bottom, and two sides, and the second bottom closing flap having a reverse fold; wherein the first and second rectangular wall panels are connected to each other along a common side, the second and third rectangular wall panels are connected to each other along a common side, the third rectangular wall panel is folded over the first rectangular wall panel and attached to the panel via a glue panel; the tops of the first and second supporting shoulders are connected via glue panels to the bottoms of the first and second rectangular wall panels, respectively, and are folded inside the carton; the tops of the first and second bottom closing flaps are connected to the bottoms of the first and second supporting shoulders, respectively, and are folded inside the carton; and the second bottom closing flap is connected via a glue panel to the reverse of the first bottom closing flap to form the one piece oval shaped carton with an automatic closing bottom for packaging an article.

5. The one piece oval shaped carton according to claim 4, wherein the first, second, and third rectangular wall panels are of substantially equal size.

6. The one piece oval shaped carton according to claim 4, wherein the second oval bottom closing flap further comprises four support flaps.

7. The one piece oval shaped carton according to claim 4, further comprising a top to maintain the structure of the oval shaped carton.

* * * * *